US011682814B2

(12) United States Patent
Worthen et al.

(10) Patent No.: US 11,682,814 B2
(45) Date of Patent: Jun. 20, 2023

(54) RF WAVEGUIDE HOUSING INCLUDING A METAL-DIAMOND COMPOSITE-BASE HAVING A WAVEGUIDE OPENING FORMED THEREIN COVERED BY A SLAB

(71) Applicant: Raytheon Company, Waltham, MA (US)

(72) Inventors: Karl L. Worthen, Dallas, TX (US); James S. Wilson, Hurst, TX (US); Joshua Lamb, Garland, TX (US)

(73) Assignee: RAYTHEON COMPANY, Waltham, MA (US)

( * ) Notice: Subject to any disclaimer, the term of this patent is extended or adjusted under 35 U.S.C. 154(b) by 17 days.

(21) Appl. No.: 17/349,018

(22) Filed: Jun. 16, 2021

(65) Prior Publication Data

US 2022/0407207 A1 Dec. 22, 2022

(51) Int. Cl.
*H01P 1/04* (2006.01)
*H01P 5/107* (2006.01)
*H01P 5/02* (2006.01)

(52) U.S. Cl.
CPC ..... *H01P 1/042* (2013.01); *H01P 5/024* (2013.01); *H01P 5/107* (2013.01)

(58) Field of Classification Search
CPC ..... H01P 1/042; H01P 5/024
USPC ..... 333/24 R, 254
See application file for complete search history.

(56) References Cited

U.S. PATENT DOCUMENTS 5,202,648 A 4/1993 McCandless
5,936,494 A 8/1999 Pollock
7,190,243 B2 * 3/2007 Tamaki ..... H01P 1/042 333/260
7,411,472 B1 8/2008 West et al.
2007/0257751 A1 * 11/2007 Jarno et al. ..... H01P 3/12 333/239
2011/0187482 A1 * 8/2011 Ohno et al. ..... H01P 5/107 333/254
2012/0057839 A1 * 3/2012 Hacker et al. ..... H01P 11/002 385/137
2021/0014986 A1 1/2021 Xia et al.

FOREIGN PATENT DOCUMENTS

EP 1367668 A1 12/2003

OTHER PUBLICATIONS

International Search Report and Written Opinion for PCT Application No. PCT/US2022/033013, dated Sep. 15, 2022, pp. 1-15.

* cited by examiner

*Primary Examiner* — Benny T Lee
(74) *Attorney, Agent, or Firm* — Cantor Colburn LLP

(57) ABSTRACT

A radio frequency (RF) waveguide housing includes a metal-diamond base with a first surface and a second surface opposite the first surface. The metal-diamond base includes an opening through a thickness of the metal-diamond base, and the opening includes a first side on a side of the first surface of the metal-diamond base and a second side on a side of the second surface of the metal-diamond base. The RF waveguide housing also includes an insert to be inserted in the opening and affixed to the metal-diamond base. The insert defines an interior volume within the opening of the metal-diamond base and a shape of the insert at the first side of the opening is configured to match an end of an RF waveguide coupled to the RF waveguide housing.

21 Claims, 4 Drawing Sheets

RF WAVEGUIDE HOUSING INCLUDING A METAL-DIAMOND COMPOSITE-BASE HAVING A WAVEGUIDE OPENING FORMED THEREIN COVERED BY A SLAB

FIELD

The present disclosure relates to radio and microwave systems and, more particularly, to a metal-diamond composite-based radio frequency (RF) waveguide housing.

BACKGROUND

In radio and microwave systems, an RF waveguide is a hollow metal conduit used to carry radio waves from one part of the system, connected to one end of the RF waveguide, to another part of the system, connected to the other end of the RF waveguide. An RF waveguide housing can be thought of as a transition module that couples to one end of an RF waveguide. The RF waveguide housing may include devices, as well as an RF connector that facilitates input/output of the radio waves into/out of the RF waveguide housing and, ultimately, the coupled end of the RF waveguide.

SUMMARY OF THE INVENTION

Disclosed herein are radio frequency (RF) waveguide housings and methods of fabricating RF waveguide housings. A non-limiting example of an RF waveguide housing includes a metal-diamond base with a first surface and a second surface opposite the first surface. The metal-diamond base includes an opening through a thickness of the metal-diamond base, and the opening includes a first side on a side of the first surface of the metal-diamond base and a second side on a side of the second surface of the metal-diamond base. The RF waveguide housing also includes an insert to be inserted in the opening and affixed to the metal-diamond base. The insert defines an interior volume within the opening of the metal-diamond base and a shape of the insert at the first side of the opening is configured to match an end of an RF waveguide coupled to the RF waveguide housing.

Another non-limiting example of a method of fabricating a radio frequency (RF) waveguide housing includes forming an opening in a metal-diamond base that has a first surface and a second surface opposite the first surface. The opening is through a thickness of the metal-diamond base, the opening includes a first side on a side of the first surface of the metal-diamond base and includes a second side on a side of the second surface of the metal-diamond base. The method also includes arranging an insert in the opening. The insert defines an interior volume within the opening of the metal-diamond base and a shape of the insert at the first side of the opening is formed to match an end of an RF waveguide coupled to the RF waveguide housing. The insert is affixed to the metal-diamond base.

Additional features and advantages are realized through the techniques of the present disclosure. Other embodiments and aspects of the disclosure are described in detail herein and are considered a part of the claimed disclosure. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts through out the drawings and the detailed description.

DETAILED DESCRIPTION OF THE INVENTION

As previously noted, an RF waveguide is a tube or conduit that conveys radio waves into or out of an RF waveguide housing that acts as a transition module. The RF waveguide and its two ends (i.e., input and output) may have a rectangular cross-sectional shape, for example. The part of the RF waveguide housing that couples to the RF waveguide must be shaped, sized, and aligned precisely to match the dimensions of the RF waveguide input or output. Based on this requirement, prior RF waveguide housing designs have used materials such as copper molybdenum (CuMo), copper tungsten (CuW), aluminum (Al), and iron-nickel alloys referred to as Kovar that facilitate precision machining to the required tolerances. However, these materials have limited thermal conductivity.

Embodiments of the systems and methods detailed herein relate to a metal-diamond composite-based RF waveguide housing. The metal-diamond composite exhibits higher thermal conductivity than materials used previously. Inserts are added in openings of the metal-diamond composite, and RF waveguides are coupled to the RF waveguide housing at the inserts. That is, while the openings in the metal-diamond composite may be imprecise, the inserts are precisely machined to mate with the RF waveguides. The inserts are formed from materials (e.g., CuMo, CuW, Al, or Kovar) that are conducive to precision machining.

Figure 1:
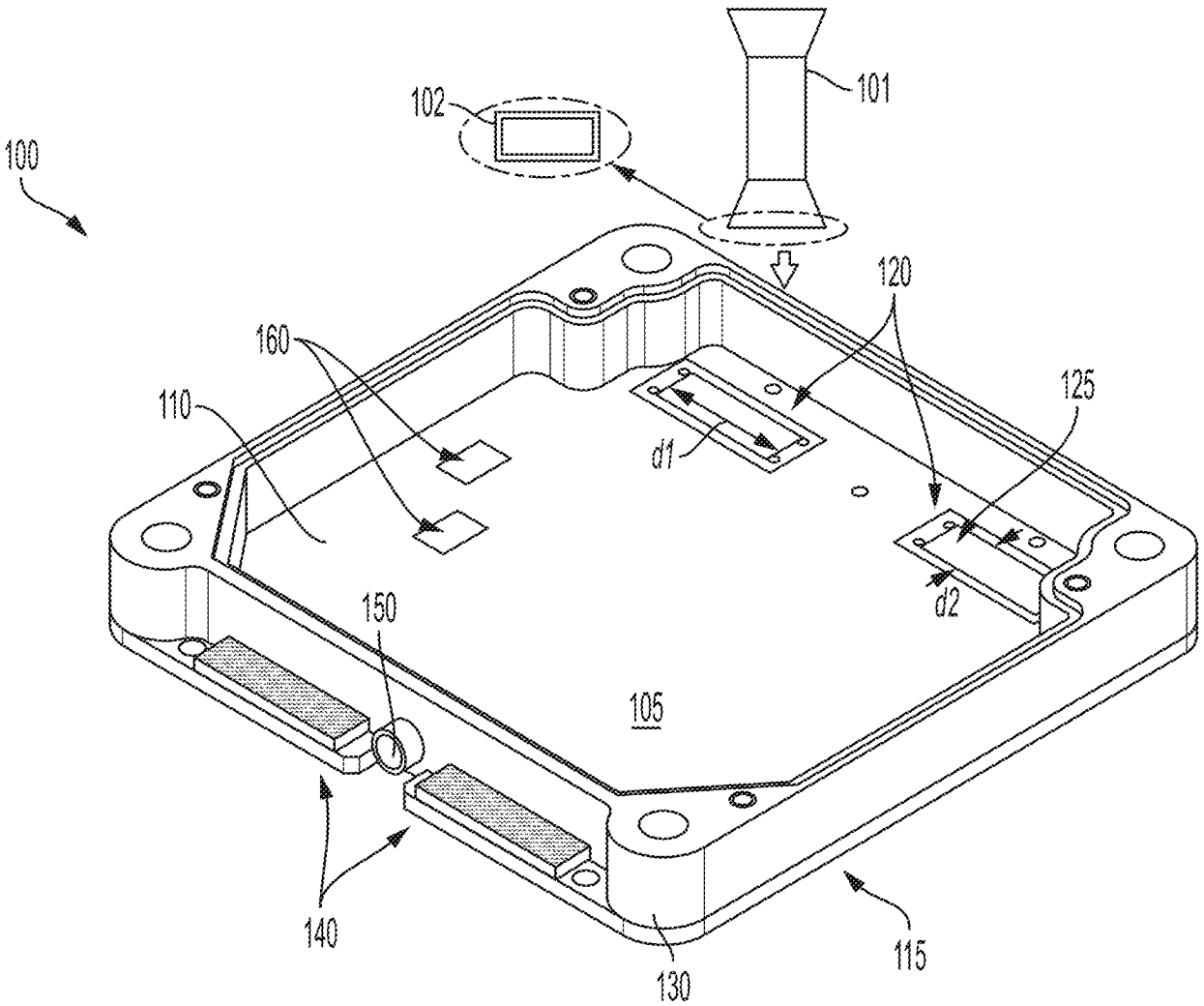
FIG. 1 is an isometric view of a radio frequency (RF) waveguide housing according to one or more embodiments.

FIG. 1 is an isometric view of an RF waveguide housing 100 according to one or more embodiments. The RF waveguide housing 100 has a first surface 105 and a second surface 115 that is opposite the first surface 105. A metal-diamond base 110 of the RF waveguide housing 100 includes one or more inserts 120 that extends through a thickness of the metal-diamond base 110 from the first surface 105 to the second surface 115. In the exemplary RF waveguide housing 100 shown in FIG. 1, the metal-diamond base 110 is exposed at the first surface 105. The metal of the metal-diamond base 110 may be aluminum, for example. However, as discussed with reference to FIGS. 6 and 7, a flange 610 of the insert 120 may cover some or all of the metal-diamond base 110 at the first surface 105. As discussed with reference to FIG. 8, additionally or alternately, a flange 610 may cover some or all of the metal-diamond base 110 at the second surface 115. The inserts 120 are shaped to define an interior volume 125.

For each insert 120, the cross-sectional shape of the interior volume 125 (i.e., the shape of the insert 120 on the side of the first surface 105, as shown in FIG. 1), which is defined by a length d1 and a width d2, matches a shape of an opening 102 in an RF waveguide 101 that couples with the insert 120. An expanded view of an opening 102 from the perspective of the insert 120 is shown in FIG. 1. The match in the shape of the insert 120 to that of the opening 102 is achieved through precise machining of the insert 120. As previously noted, the material of the insert 120 must be selected to facilitate the precision machining. Exemplary materials include CuMo, CuW, Al, iron-nickel alloy referred to as Kovar, and metalized plastic. As also noted, the materials needed for the insert 120 may not provide the thermal conductivity needed by devices 160 that are located in the RF waveguide housing 100 (e.g., on the first surface 105, as shown). Thus, according to one or more embodiments, devices 160 are placed on the metal-diamond base 110, which has much higher thermal conductivity as compared with materials used for the insert 120.

The RF waveguide housing 100 includes a frame 130 that may be comprised of metal and is typically the same material as the insert 120. Two exemplary ceramic feedthroughs 140 are shown. Ceramic feedthroughs 140 are ceramic to metal fabrications that mitigate leakage of RF energy transmitted between external devices and the RF waveguide housing 100. An optional RF connector 150 is also shown. This RF connector 150 facilitates input or output of RF energy into or out of the RF waveguide housing 100. The materials of the metal-diamond base 110, the inserts 120, and the ceramic feedthroughs 140 are selected to have a similar coefficient of thermal expansion (CTE).

Figure 2:
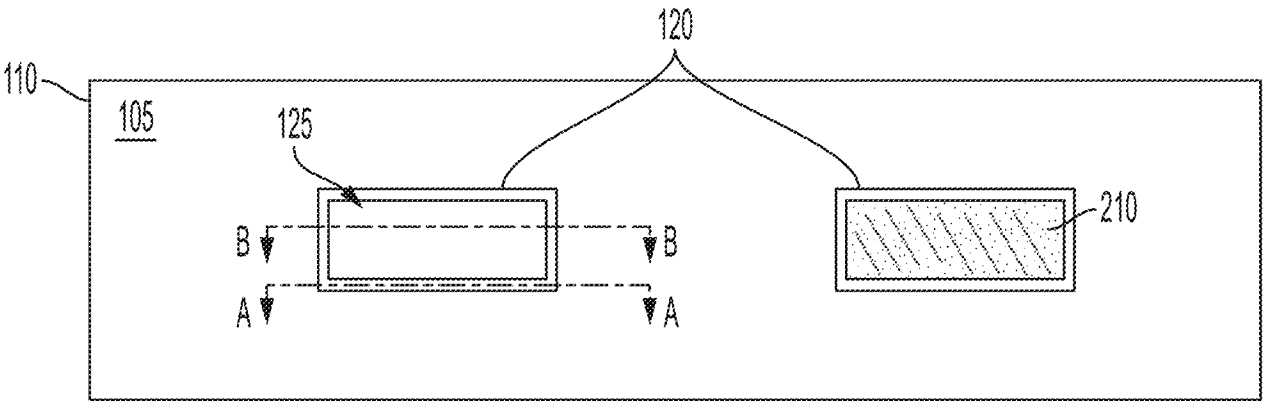
FIG. 2 is a top view of aspects of an RF waveguide housing according to one or more embodiments.

FIG. 2 is a top view of aspects of an RF waveguide housing 100 (FIG. 1) according to one or more embodiments. The metal-diamond base 110 is visible at the first surface 105 and two inserts 120 are shown. One of the inserts is shown with a ceramic slab 210 covering the interior volume 125. When the interior volume 125 defined by each insert 120 is covered with a ceramic slab 210, the RF waveguide housing 100 may be hermetically sealed. The ceramic slab 210 is transparent to RF energy to/from an RF waveguide that couples to the RF waveguide housing 100 while keeping dust and other particles out of the interior volume 125. The cross-sections A-A and B-B indicated in FIG. 2 are shown, respectively, in FIGS. 3 and 4.

Figure 3:
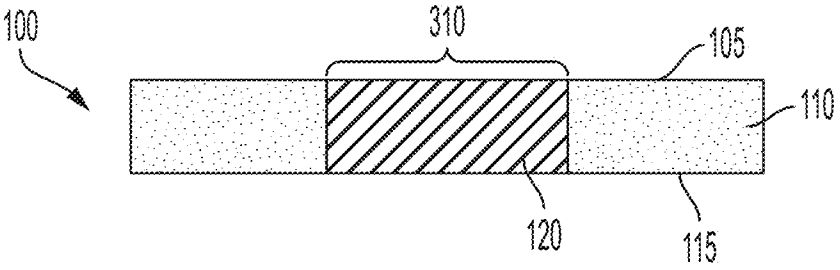
FIG. 3 is a cross-sectional view through an insert, indicated as A-A in FIG. 2.
Figure 4:
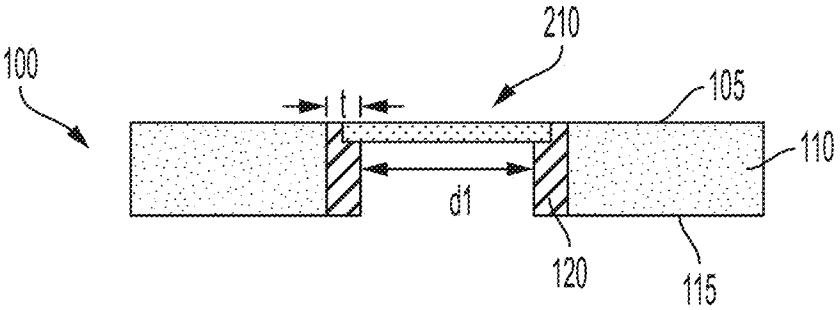
FIG. 4 is a cross-sectional view through the interior volume defined by an insert, indicated as B-B in FIG. 2.

FIG. 3 is a cross-sectional view through an insert 120, indicated as A-A in FIG. 2. The insert 120 is introduced into an opening 310 in the metal-diamond base 110. The insert 120 may be affixed to the metal-diamond base 110 via epoxy, soldering, or brazing, for example. This process is further discussed with reference to FIG. 5. FIG. 4 is a cross-sectional view through the interior volume 125 (FIG. 2) defined by an insert 120, indicated as B-B in FIG. 2. The insert 120 essentially acts as a frame from the interior volume 125, as shown in FIG. 1. Thus, in the view shown in FIG. 4, two ends of that frame are visible. As previously noted, the opening 310 (FIG. 3) in the metal-diamond base 110 need not be sized precisely. The thickness t of the insert 120 can be controlled precisely to ensure that the cross-sectional dimensions (e.g., length d1 as shown) of the interior volume 125 match the opening in the RF waveguide that couples with the RF waveguide housing 100.

Figure 5:
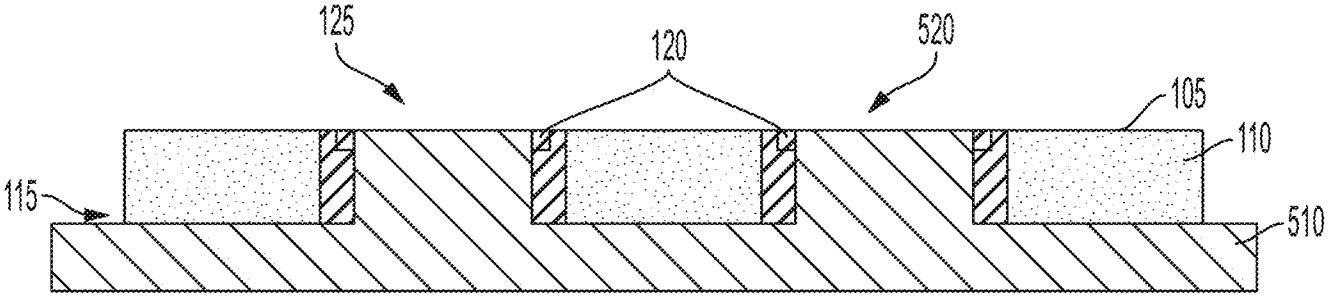
FIG. 5 is a cross-sectional view through the interior volume defined by an insert during an exemplary brazing process.

FIG. 5 is a cross-sectional view through the interior volume 125 defined by an insert 120 during an exemplary brazing process. A braze fixture 510 that holds the parts of the RF waveguide housing 100 in place during a brazing process is shown. The exemplary braze fixture 510 is shown with two posts 520 that fit into the interior volume 125 defined by the inserts 125. The material of the braze fixture 510 may be $Cu_{85}Mo_{15}$, $Cu_{90}W_{10}$, or aluminum oxide ($Al_2O_3$). Beyond withstanding the high temperatures of the brazing process, the material of the braze fixture 510 is selected to match the CTE of the metal-diamond base 110 and the inserts 120 such that the braze fixture 510 stays in place during the braze.

Figure 6:
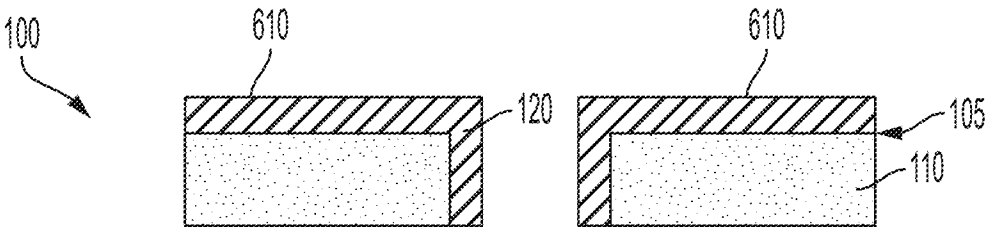
FIG. 6 is a cross-sectional view of aspects of an exemplary RF waveguide housing according to one or more embodiments.

FIG. 6 is a cross-sectional view of aspects of an exemplary RF waveguide housing 100 according to one or more embodiments. The insert 120 is shown to include a flange 610 that covers the metal-diamond base 110 at the first surface 105. The size of the flange 610 is not limited to be any particular size but may be limited by the presence of other inserts 120. That is, the flange 610 cannot extend into the interior volume 125 defined by another insert 120. The flange 610 may be soldered or brazed to the first surface 105 of the metal-diamond base 110 to more strongly affix the insert 120 to the metal-diamond base 110.

Figure 7:
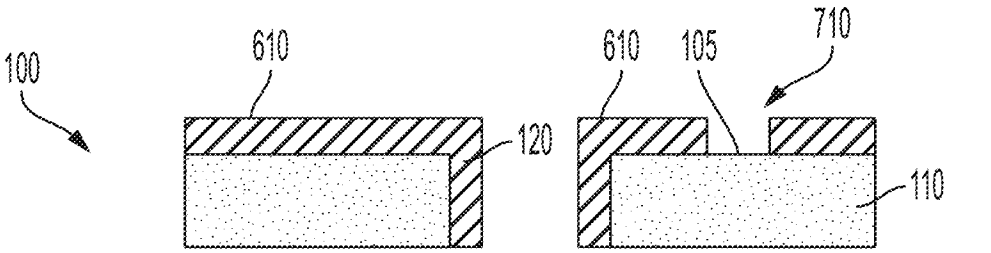
FIG. 7 is a cross-sectional view of aspects of an exemplary RF waveguide housing according to one or more embodiments.

FIG. 7 is a cross-sectional view of aspects of an exemplary RF waveguide housing 100 according to one or more embodiments. Like the flange 610 shown in FIG. 6, the flange 610 shown in FIG. 7 covers the metal-diamond base 110 at the first surface 105. The flange 610 includes a cut-out portion 710 that exposes the first surface 105 of the metal-diamond base 110. A device 160 (FIG. 1) may be placed on the exposed first surface 105 of the metal-diamond base 110 in the cut-out portion 710 to take advantage of the higher thermal conductivity of the metal-diamond base 110 as compared with the flange 610 of the insert 120. Based on the area covered by the flange 610, two or more cut-out portions 710 may be included.

Figure 8:
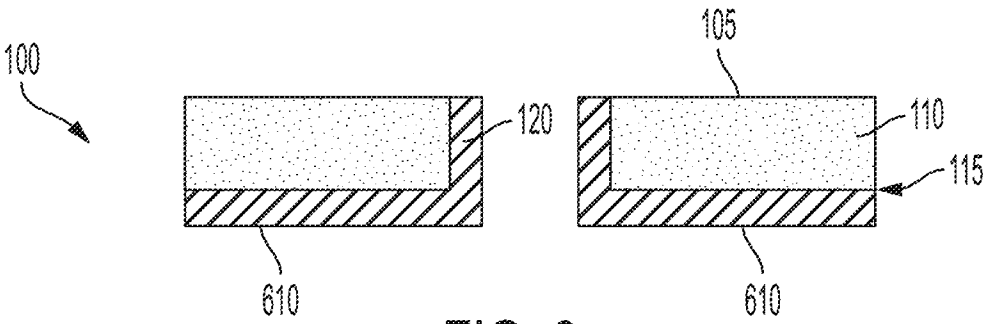
FIG. 8 is a cross-sectional view of aspects of an exemplary RF waveguide housing according to one or more embodiments.

FIG. 8 is a cross-sectional view of aspects of an exemplary RF waveguide housing 100 according to one or more embodiments. The insert 120 is shown to include a flange 610 that covers the metal-diamond base 110 at the second surface 115. The size of the flange 610 is not limited to be any particular size.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form detailed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the various embodiments with various modifications as are suited to the particular use contemplated.

While certain embodiments have been described herein, it will be understood that those skilled in the art, both now and in the future, may make various improvements and enhancements which fall within the scope of the claims which follow. These claims should be construed to maintain the proper protection for the disclosure as first described.

What is claimed is:

1. A radio frequency (RF) waveguide housing comprising:

a metal-diamond base with a first surface and a second surface opposite the first surface, the metal-diamond base including an opening through a thickness of the metal-diamond base, the opening including a first side on a side of the first surface of the metal-diamond base and including a second side on a side of the second surface of the metal-diamond base; and an insert configured to be inserted in the opening and affixed to the metal-diamond base, wherein the insert defines an interior volume within the opening of the metal-diamond base and a shape of the insert at the first side of the opening is configured to match an end of an RF waveguide coupled to the RF waveguide housing; and a slab configured to cover the interior volume on the first side.

2. The RF waveguide housing according to claim 1, wherein the metal-diamond base is an aluminum-diamond base.

3. The RF waveguide housing according to claim 1, wherein the insert is affixed to the metal-diamond base via epoxy, brazing, or soldering.

4. The RF waveguide housing according to claim 1, wherein the insert is copper molybdenum (CuMo), copper tungsten (CuW), aluminum (Al), an iron-nickel alloy, or metalized plastic.

5. The RF waveguide housing according to claim 1, wherein the insert includes a flange affixed to the first surface of the metal-diamond base.

6. The RF waveguide housing according to claim 5, wherein the flange includes a cut-out portion to accommodate a device that contacts the first surface of the metal-diamond base.

7. The RF waveguide housing according to claim 5, wherein a second flange is also affixed to the second surface of the metal-diamond base.

8. The RF waveguide housing according to claim 1, wherein the slab is a ceramic slab.

9. A method of fabricating a radio frequency (RF) waveguide housing, the method comprising:

forming an opening in a metal-diamond base that has a first surface and a second surface opposite the first surface, wherein the opening is through a thickness of the metal-diamond base, the opening includes a first side on a side of the first surface of the metal-diamond base and includes a second side on a side of the second surface of the metal-diamond base;

arranging an insert in the opening, wherein the insert defines an interior volume within the opening of the metal-diamond base and a shape of the insert at the first side of the opening is formed to match an end of an RF waveguide coupled to the RF waveguide housing; and affixing the insert to metal-diamond base; and covering the interior volume with a slab on the first side.

10. The method according to claim 9, wherein the affixing the insert to the metal-diamond base is via epoxy or soldering.

11. The method according to claim 10, wherein the affixing the insert to the metal-diamond base is via brazing, and the brazing includes using a brazing fixture, which holds the insert and the metal-diamond base in place during the brazing, wherein the brazing fixture is formed of a material selected based on a coefficient of thermal expansion of the insert and the metal-diamond base.

12. The method according to claim 9, wherein the metal-diamond base is an aluminum-diamond base.

13. The method according to claim 9, wherein the insert is copper molybdenum (CuMo), copper tungsten (CuW), aluminum (Al), an iron-nickel alloy, or a metalized plastic.

14. The method according to claim 9, wherein the slab is a ceramic slab.

15. The method according to claim 9, further comprising forming the insert to include a flange and affixing the flange to the first surface of the metal-diamond base.

16. The method according to claim 15, wherein the forming the insert includes affixing the second flange to the second surface of the metal-diamond base.

17. The method according to claim 15, wherein the forming the insert to include the flange includes forming a cut-out portion in the flange to accommodate a device that contacts the first surface of the metal-diamond base.

18. A radio frequency (RF) waveguide housing comprising:

a metal-diamond base with a first surface and a second surface opposite the first surface, the metal-diamond base including an opening through a thickness of the metal-diamond base, the opening including a first side on a side of the first surface of the metal-diamond base and including a second side on a side of the second surface of the metal-diamond base;

an insert configured to be inserted in the opening and affixed to the metal-diamond base, wherein the insert defines an interior volume within the opening of the metal-diamond base and a shape of the insert at the first side of the opening is configured to match an end of an RF waveguide coupled to the RF waveguide housing; and a metal frame encompassing the metal-diamond base inside the metal frame and a ceramic feed-through and an RF connector outside the metal frame.

19. The RF waveguide housing according to claim 18, wherein the insert is copper molybdenum (CuMo), copper tungsten (CuW), aluminum (Al), an iron-nickel alloy, or metalized plastic.

20. The RF waveguide housing according to claim 18, wherein the insert is affixed to the metal-diamond base via epoxy, brazing, or soldering.

21. The RF waveguide housing according to claim 18, wherein the metal-diamond base is an aluminum-diamond base.

* * * * *